US005456033A

United States Patent [19]

Sachnoff

[11] Patent Number: 5,456,033

[45] Date of Patent: Oct. 10, 1995

[54] ADVERTISING DISPLAY

[75] Inventor: Lee E. Sachnoff, Deerfield, Ill.

[73] Assignee: Braeside Plastics Corporation, Antioch, Ill.

[21] Appl. No.: 172,476

[22] Filed: Dec. 23, 1993

[51] Int. Cl.[6] ..... G09F 03/18

[52] U.S. Cl. ..... 40/661; 40/649

[58] Field of Search ..... 40/661, 649, 124, 40/1; D20/40

[56] References Cited

U.S. PATENT DOCUMENTS

| | | | |
|---|---|---|---|
| D. 328,473 | 8/1992 | Mayden | D20/40 |
| D. 333,163 | 2/1993 | Mendelsohn | D20/40 |
| D. 343,867 | 2/1994 | Mendelsohn | D20/40 |
| 1,943,295 | 1/1934 | Block . | |
| 2,409,814 | 10/1946 | Vargish | 40/649 X |
| 3,319,369 | 5/1967 | Severson . | |
| 3,820,262 | 6/1974 | Dewsnap | 40/661 |
| 3,956,837 | 5/1976 | Itano | 40/661 X |
| 4,005,537 | 2/1977 | von Camber et al. . | |
| 4,326,349 | 4/1982 | Daughtry | 40/152.1 |
| 4,374,376 | 2/1983 | Pillifant, Jr. . | |
| 5,197,215 | 3/1993 | Torsleff | 40/642 |

FOREIGN PATENT DOCUMENTS

| | | | |
|---|---|---|---|
| 1454427 | 8/1966 | France . | |
| 2318038 | 3/1977 | France | 40/661 |
| 2203721 | 10/1988 | United Kingdom | 40/661 |

OTHER PUBLICATIONS

"P/O/P Times®", *The National News Publication of Point-of-Purchase Advertising and Display,* vol. 6, No. 2, pp. 1, 26, 28, 41, 50–52 & 54 (Mar. 1993).

*Braeside Promotional Displays,* Brochure, published in 1991.

*Primary Examiner*—Kenneth J. Dorner

*Assistant Examiner*—Joanne Silbermann

*Attorney, Agent, or Firm*—Marshall, O'Toole, Gerstein, Murray & Borun

[57] ABSTRACT

An advertising display for holding and displaying printed advertisements above a flat surface includes first and second transparent, vertical plates disposed parallel to and in close proximity to one another and a support for holding the first and second transparent parallel plates above a flat surface. The support includes first and second diagonally disposed leg portions, each of which includes two parallel plates and an end piece which attaches the two parallel plates at an edge thereof. The first and second vertical plates are capable of holding a first advertisement therebetween in a replaceable manner while the plates of the first and second leg portions are capable of holding second and third advertisements therebetween in a permanent manner. The advertising display further includes a lip attached to one of the vertical plates which comes into contact with the other of the vertical plates for retaining the first advertisement therebetween. Furthermore, one of the plates of each of the first and second leg portions includes a ledge on edges thereof to retain the second and third advertisements between the plates of the first and second leg portions, respectively.

17 Claims, 3 Drawing Sheets

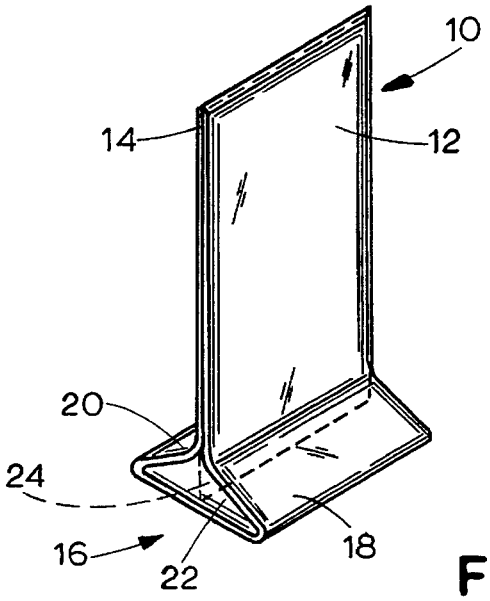
FIGURE 1
PRIOR ART
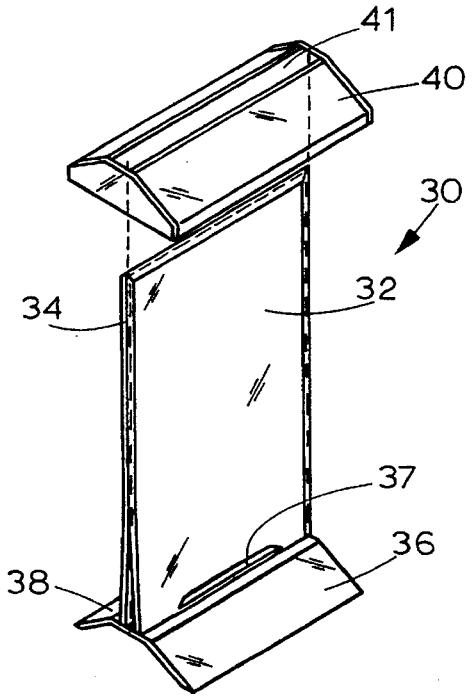
FIGURE 2
PRIOR ART
FIGURE 3
PRIOR ART
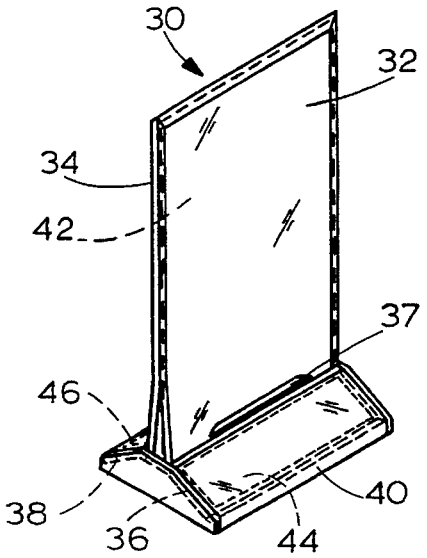

ADVERTISING DISPLAY

TECHNICAL FIELD

The present invention relates generally to advertising displays, and more particularly to freestanding point of purchase (POP) displays for displaying multiple printed advertisements above a flat surface.

BACKGROUND ART

It is commonly known to provide POP displays for displaying product advertisements or other information on counters or other flat surfaces in, for example, convenience stores, liquor stores, bars or other stores in which an advertised product is likely to be purchased or in which the displayed information is likely to be helpful to customers. Typically, POP displays are made of transparent plastic or other lightweight material which is easy to mold and manufacture. POP displays commonly include an upright vertical portion having two adjacent transparent plates capable of holding one or more large printed advertisements therebetween and a base portion for supporting the vertical portion above a flat surface. Typically, the base portion includes two legs which extend diagonally outward from the vertical upright portion and which come into contact with the flat surface. Sometimes, smaller printed advertisements are held and displayed by each of the legs or, alternatively, advertising is silkscreened, etched or otherwise printed onto a surface of each of the legs and is viewable therethrough. In this manner, POP displays may display up to four different advertisements; two held by the upright vertical portion and one held by or etched onto each of the two legs of the base portion.

Referring now to FIG. 1, a well known POP display 10 is illustrated. The POP display 10 is made of a single piece of plastic having vertical transparent plates 12 and 14 and a triangular shaped base portion 16 which includes diagonal leg pieces 18 and 20 and a bottom support piece 22. A printed advertisement 24 (shown in phantom relief) is placed between the plates 12 and 14 such that both sides of the advertisement 24 are viewable through the transparent plates 12 and 14. The POP display 10 is considered inadequate, however, because the leg pieces 18 and 20 are not capable of holding and displaying printed advertisements. Although advertising may be silkscreened, etched or otherwise engraved on a surface of each of the leg pieces 18 and 20, this is a relatively expensive and time-consuming process.

FIGS. 2 and 3 illustrate another known POP display 30. The POP display 30 is made of three separate pieces which are all, preferably, formed of plastic or other transparent material. The first piece includes a vertical plate 32 connected to a leg 36 and a lip 37 which extends out from the vertical plate 32 at a point just above the leg 36. Likewise, the second piece includes a vertical plate 34 connected to a leg 38 and a lip (not shown in the Figures) which extends out from the vertical plate 34. The third piece comprises a base 40 having a space 41 therein. As indicated in FIG. 2, the POP display 30 is assembled by placing the vertical plates 32 and 34 adjacent to one another, inserting the upper edges of the plates 32 and 34 into the hole 41 of the base 40 and slipping the base 40 down over the vertical plates 32 and 34 until the base 40 slides over the lip 37 and the lip connected to the vertical plate 34. In this manner, the base 40 comes into contact with the upper surfaces of the leg pieces 36 and 38 and holds the vertical plates 32 and 34 together, as shown in FIG. 3.

When assembled, the POP display 30 is capable of holding one or more large printed advertisements 42 (shown in phantom relief) between the vertical plates 32 and 34 and of holding smaller printed advertisements 44 and 46 (shown in phantom relief) between the leg pieces 36 and 38 and the base portion 40. Although the POP display 30 is capable of holding and displaying three or more separate printed advertisements, this POP display is considered inadequate because it requires tedious and time-consuming manual labor to assemble and because it requires multiple molds to form the separate pieces thereof.

It is desirable, therefore, to develop an advertising or POP display which is capable of displaying three or more printed advertisements of at least two separate sizes, wherein one of the printed advertisements is oriented vertically with respect to a flat surface and two of the printed advertisements are oriented diagonally with respect to the flat surface. Furthermore, it is desirable to develop such a POP display which can be formed in a single mold and which requires minimal manual labor for assembly thereof.

SUMMARY OF THE INVENTION

In accordance with one aspect of the present invention, an advertising display for holding and tdisplaying printed advertisements above a flat surface includes first and second transparent upper display plates disposed in parallel and in close proximity to one another which are capable of accepting a first advertisement therebetween. The advertising display also includes a base section having first and second leg portions which support the first and second transparent upper plates on the flat surface. Each of the leg portions includes a transparent lower display plate, a lower support plate disposed in close proximity thereto and an end piece which attaches one end of the lower display plate to an end of the lower support plate. Each leg portion is capable of accepting a further advertisement between the lower display plate, the lower support plate and the end piece associated therewith.

Preferably, the base portion includes a ledge on each side of the lower display plates for retaining the advertisements between the lower display plates and the lower support plates. Furthermore, one of the transparent upper display plates includes a lip on the edges thereof which comes into contact with the other upper display plate for holding the first advertisement between the first and second upper display plates. The upper display plates, the lower support plates and the lower display plates are all formed of a single continuous sheet of transparent material.

According to another aspect of the present invention, an advertising display for displaying first, second and third printed advertisements above a flat surface includes first, second and third pairs of display plates which are angularly offset from one another with respect to a longitudinal axis disposed perpendicular to the normal of the flat surface. The plates of each pair of transparent display plates are disposed parallel to and in close proximity to one another and the plates of the second and third pairs of display plates are connected together at ends thereof. The first pair of display plates is capable of accepting a printed advertisement of a first size therebetween while the second and third pairs of display plates are capable of accepting printed advertisements of a second size, preferably smaller than the first size, therebetween. The second and third pairs of display plates support the first pair of display plates vertically with respect to the flat surface.

According to another aspect of the present invention, a method of producing an advertising display for displaying multiple printed advertisements includes the steps of forming a display from a continuous piece of transparent material, inserting advertisements therein and reshaping the display to form the final advertising display. When formed the display includes two rectangular-shaped planar plates of a first size connected to one of two V-shaped pieces. Each of the V-shaped pieces is formed of two rectangular-shaped planar plates of a second size, smaller than the first size, which are connected together at a junction to form an interior groove. Advertisements are inserted into the interior grooves of the V-shaped pieces and the junction of each of the V-shaped pieces is heated to make the material at the junction pliable. Thereafter, the rectangular-shaped plates of each of the V-shaped pieces are rotated with respect to one another until they are disposed parallel to and in close proximity to each other. This rotating step simultaneously traps the advertisements between the rectangular-shaped plates of each of the V-shaped pieces and disposes the rectangular-shaped plates of the first size parallel to and in close proximity to one another. A further printed advertisement is then inserted between the rectangular-shaped plates of the first size so that it is viewable therethrough. Preferably, the advertisements are permanently trapped between the rectangular shaped plates of the V-shaped pieces while the further advertisement is easily replaceable.

A lip may be formed on one of the rectangular-shaped plates of the first size to retain the further printed advertisement therebetween. Likewise, a ledge may be formed on one of the rectangular-shaped plates of each of the V-shaped pieces to retain the smaller printed advertisements between the rectangular-shaped plates of each of the V-shaped pieces.

BRIEF DESCRIPTION OF THE DRAWING

FIG. 1 is a perspective view of a first prior art point of purchase display;

FIG. 2 is a perspective view of a second, non-assembled, prior art point of purchase display;

FIG. 3 is a perspective view of the prior art point of purchase display of FIG. 2 after it has been assembled;

DESCRIPTION OF THE PREFERRED EMBODIMENT

Figure 5:
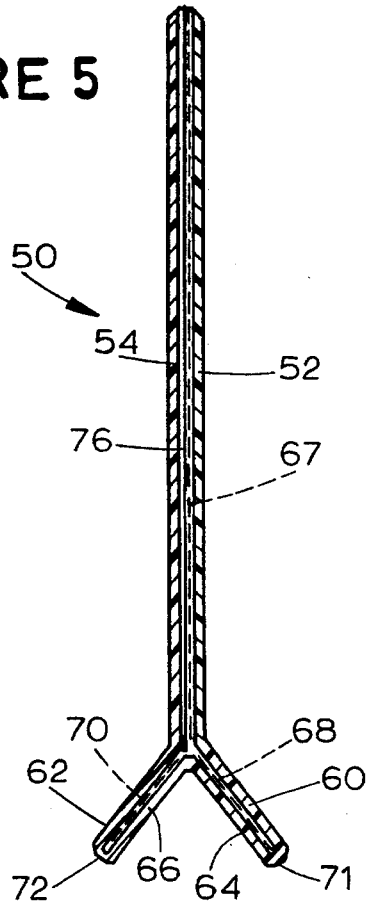
FIG. 5 is a sectional view taken along section lines 5—5 of FIG. 4 illustrating the advertising display according to the present invention.
Figure 4:
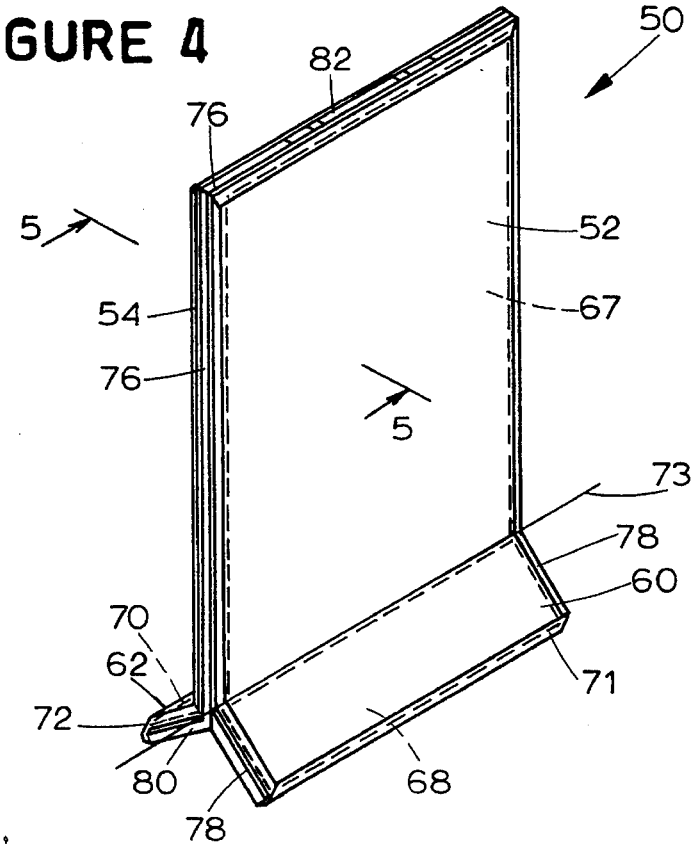
FIG. 4 is a perspective view of the advertising display according to the present invention.

FIGS. 4 and 5 illustrate an advertising display 50 developed according to the present invention. The advertising display 50 includes a pair of vertically disposed upper display plates 52 and 54 and a base including lower display plates 60 and 62 and lower support plates 64 and 66 which are associated with the lower display plates 60 and 62, respectively. The upper display plates 52 and 54 are disposed parallel to and in close proximity to one another and are capable of holding a first printed advertisement 67 (shown in phantom relief) therebetween. Likewise, the lower display plate 60 is disposed parallel to and in close proximity to the lower support plate 64 while the lower display plate 62 is disposed parallel to and in close proximity to the lower support plate 66. The pairs of plates 60, 64 and 62, 66 entrap printed advertisements 68 and 70 (shown in phantom relief) therebetween.

As clearly shown in FIG. 5, the lower display plates 60 and 62 are connected to the lower support plates 64 and 66, respectively, at end portions or edges 71 and 72. The edges 71 and 72 come in contact with a flat supporting surface when the advertising display 50 is located thereon so that the advertising display 50 is symmetrical about a longitudinal axis 73. In this manner, the lower plates 60, 62, 64 and 66 are supported in a diagonal direction with respect to the flat surface while the upper display plates 52 and 54 are supported in a vertical direction with respect to the flat surface. Preferably, the upper display plate 52 is offset from the lower display plate 60 at a rotational angle of approximately 120 degrees while the upper display plate 54 is offset from the lower display plate 62 at a rotational angle of approximately 120 degrees. Furthermore, the lower support plates 64 and 66 are displaced from one another at a rotational angle of approximately 120 degrees. Alternatively, the plates 52 and 60, 54 and 62, 64 and 66 may be separated from one another by any other desired rotational angles, as long as the rotational angles between the upper display plates 52, 54 and the lower display plates 60 and 62, respectively, are greater than 90 degrees.

The upper display plate 54 includes a lip 76 on three edges thereof which comes into contact with the upper display plate 52 when the upper display plates 52 and 54 are disposed as shown in FIGS. 4 and 5. The lip 76 prevents the printed advertisement 67 from sliding out from between the upper display plates 52 and 54. Likewise, the lower display plates 60 and 62 include ledges 78 and 80, respectively, on two edges thereof. The ledges 78 and 80 are disposed adjacent to the lower support plates 64 and 66, respectively, and entrap the printed advertisements 68 and 70 between the plates 60 and 64 and the plates 62 and 66, respectively. It should be clear to one skilled in the art that any portion or all of the lip 76 can be formed on the upper display plate 52 and that one or both of the ledges 78 and 80 can be formed on the lower support plates 64 and 66, respectively.

Preferably all of the plates 52, 54, 60, 62, 64 and 66 are beveled at the edges thereof to provide a pleasing appearance during use of the advertising display 50. Furthermore, the lip 76 includes a thumbnail hole 82 therein which enables a person to pry the upper display plates 52 and 54 apart so as to insert the printed advertisement 67 therebetween.

The advertising display 50 is formed of a continuous sheet of transparent material, for example, plastic, or more specifically, crystal styrene or acrylic. In this manner, the printed advertisement 67, which may include advertisements or other printed information on both sides thereof, is viewable through the upper display plates 52 and 54 while the printed advertisements 68 and 70, which may include advertisements or other printed information on the upper surfaces thereof, are viewable through the lower display plates 60 and 62, respectively. If desired, the printed advertisements 68 and 70 may include advertisements or other printed information on both sides so that the information on the lower sides thereof is viewable through the lower support plates 64 and 66, respectively.

Figure 6:
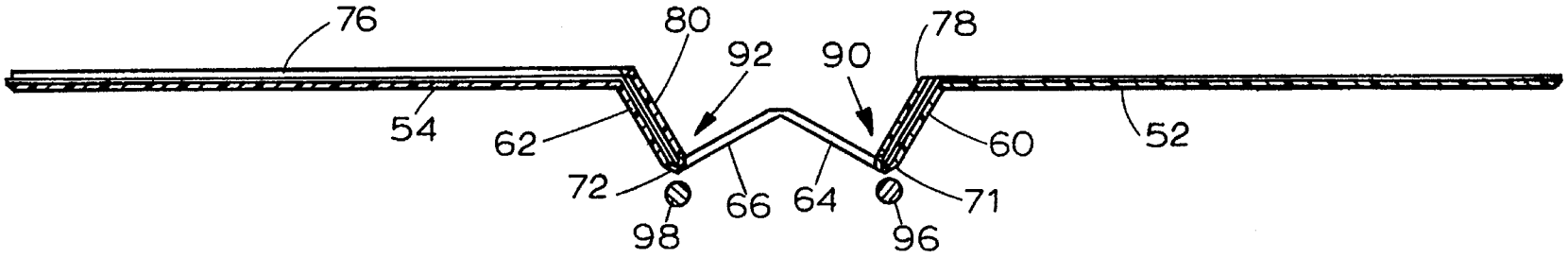
FIG. 6 is a side view of the advertising display according to the present invention as formed in a mold.
Figure 7:
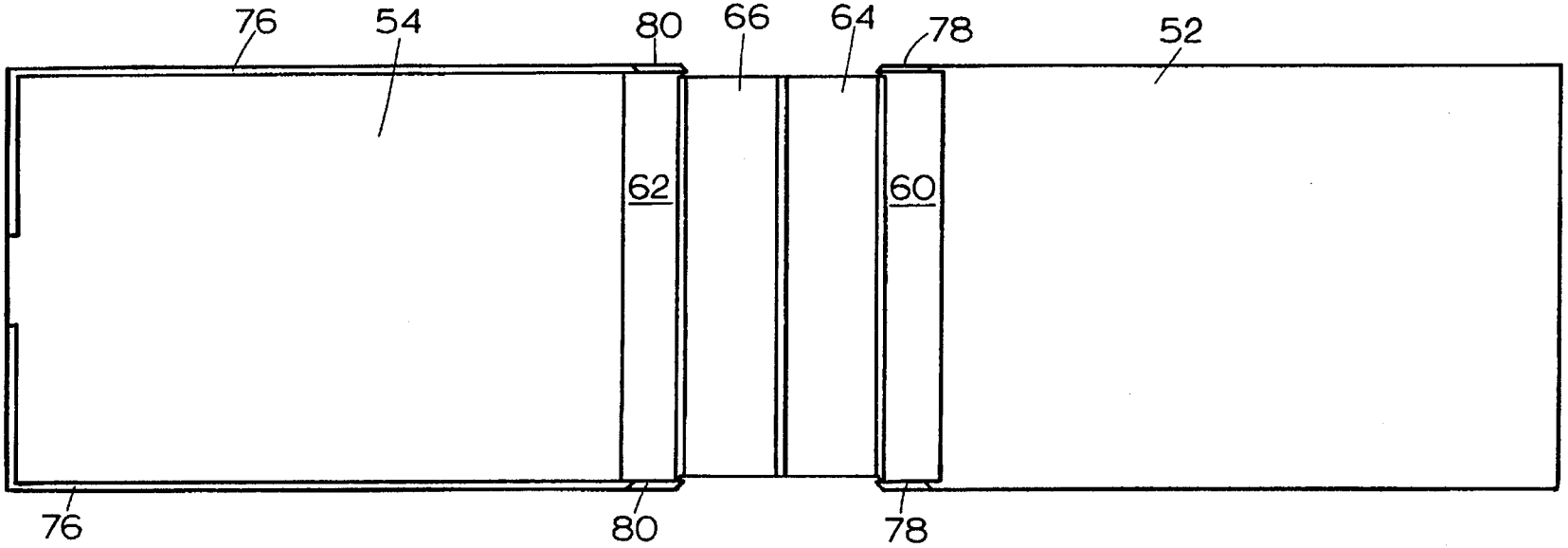
FIG. 7 is a top view of the advertising display according to the present invention as formed in a mold.

During fabrication, the advertising display 50 is formed as a continuous piece in a single mold, using commonly known techniques. As illustrated in FIGS. 6 and 7, the advertising display 50 is molded so that the upper display plates 52 and 54 are parallel to and in approximately the same plane as one another. Each of the upper display plates 52 and 54 is connected to one of a first or second V-shaped portion comprising the plates 60 and 64 or the plates 62 and 66 respectively. As clearly illustrated in FIG. 6, the plates 60 and 64 are connected at the edge 71, the plates 62 and 66 are connected at the edge 72, and the two V-shaped portions are connected together at the edges of the plates 62 and 64. Thus, as shown in FIG. 6, internal grooves 90 and 92 are formed between plates 60 and 64 and the plates 62 and 66, respectively. Furthermore, as clearly shown in FIG. 7, the lip 72 is formed on three edges of the upper display plate 54 and the ledges 78 and 80 are formed on two edges of the lower display plates 60 and 62, respectively.

After the advertising display 50 is formed in the mold, as shown in FIGS. 6 and 7, the printed advertisements 68 and 70 are inserted into the internal grooves 90 and 92, respectively. Heat is then applied to the edges 71 and 72 with the use of, for example, resistance wires 96 and 98, indicated in FIG. 6, to make the material at the edges 71 and 72 pliable. The advertising display 50 is then reformed to be substantially as shown in FIG. 4 by rotating the upper display plates 52 and 54 about the pliable edges 71 and 72 until they are parallel to and in close proximity to one another. During this reforming process the lower display plate 60 is rotated towards the lower support plate 64 until the lower display plate 60 is substantially parallel to the lower support plate 64. Likewise the lower display plate 62 is rotated towards the lower support plate 66 until the lower display plate 62 is substantially parallel to the lower support plate 66. As a consequence of these steps, the printed advertisement 68 is permanently trapped between the plates 60, 64 and the ledges 78 while the printed advertisement 70 is permanently trapped between the plates 62, 66 and the ledges 80.

Heat is then removed from the lower edges 71 and 72 and the material there is allowed to reharden so that the advertising display 50 is permanently formed as shown in FIG. 4. The upper display plates 52 and 54 are then pried apart with the use of, for example, the thumbnail hole 82, and the printed advertisement 67 is inserted therebetween. The upper display plates 52, 54 are then allowed to come together so that the printed advertisement 67 is trapped between the upper display plates 52 and 54 and the lip 76. Importantly, the printed advertisement 67 can be easily replaced at any time which allows the advertising display 50 to be periodically adapted for new uses or for displaying different advertisements or other information.

As will be evident to one skilled in the art, the angles between the plates 52 and 60, the plates 54 and 62, and the plates 64 and 66, as formed in the mold, are critical. As noted before, all of these angles are preferably 120 degrees, however, any other desired angles can be used. It is highly preferred that the angle between the plates 52 and 60 is equal to the angle between the plates 54 and 62. These angles can differ, however, as long as the advertising display 50 is capable of being adequately supported on a flat surface when the advertising display 50 is reformed as shown in FIG. 4. Furthermore, the angles between the plates 52, 60, the plates 54, 62 and the plates 64, 66 can be chosen to provide a non-zero, acute angle between the plates 60 and 64 and/or the plates 62 and 66 (rather than the previously described parallel relationship) when the upper display plates 52 and 54 are parallel and in close proximity to one another as shown in FIG. 4. Although any non-zero acute angle can be used in such a configuration, the height of the ledges 78 and 80 should be chosen to assure that the printed advertisements 68 and 70 are adequately trapped between the plates 60, 64 and the plates 62, 66, respectively, when the upper display plates 52 and 54 are rotated towards each other as shown in FIG. 4.

Preferably the upper display plates 52 and 54 are approximately 6 inches long, 4¼ inches wide and ⅛th of an inch thick. The lower display plates 60, 62 and lower support plates 64 and 66 are approximately 1⅛th inch long, 4¼ inches wide and ⅛th of an inch thick. Furthermore the height of the lip 76 is approximately 1/16th of an inch while the height of the ledges 78 and 80 is approximately ⅛th of an inch. It should be noted, however, that these dimensions are illustrative only and that any other desired dimensions can be used.

It should be noted that the term printed advertisements as used herein includes any inserts having any type of information thereon including, for example, drawings, photos, sketches, pictures, writing, paintings or the like, or blank cards which can be inscribed or otherwise written onto after manufacture and/or sale of the display 50.

Numerous modifications and alternative embodiments of the invention will be apparent to those skilled in the art in view of the foregoing description. Accordingly, this description is to be construed as illustrative only. The details of the structure may be varied substantially without departing from the spirit of the invention, and the exclusive use of all modifications, which are within the scope of the appended claims, is reserved.

It is claimed:

1. An advertising display for holding and displaying inserts above a flat surface, comprising:

means for holding a first insert including first and second transparent, upper plates disposed parallel to and in close proximity to each other, which are capable of accepting a first insert therebetween; and means for supporting the holding means above the flat surface including first and second leg portions which are substantially smaller in one dimension than the upper plates, wherein the first and second leg portions each include;

a transparent lower display plate;

a lower support plate disposed at a small acute angle to and in close proximity to the lower display plate;

an end portion connecting one end of the lower display plate to one end of the lower support plate; and ledges attached to two sides of the lower support plate or the lower display plate which permanently retain a further insert between the lower display plate and the lower support plate;

wherein each leg portion is capable of holding the further inserts between the lower display plate, the lower support plate, the ledges and the end portion and wherein the lower support plates of the first and second leg portions are angularly offset with respect to one another and include edges which are in close proximity to one another.

2. The advertising display for holding and displaying inserts above a flat surface as set forth in claim 1, wherein the holding means holds the first insert in a replaceable manner.

3. The advertising display for holding and displaying inserts above a flat surface as set forth in claim 1, wherein the small acute angle is approximately zero degrees such that the lower support plates of each of the leg portions are disposed substantially parallel to the lower display plates of each of the leg portions, respectively.

4. The advertising display for holding and displaying inserts above a flat surface as set forth in claims 3, wherein the lower support plates of the first and second leg portions are attached to one another.

5. The advertising display for holding and displaying inserts above a flat surface as set forth in claim 4, wherein the first and second upper plates, the lower display plates and the lower support plates are formed of a single continuous sheet of material.

6. The advertising display for holding and displaying inserts above a flat surface as set forth in claim 3, further including first means for retaining the first insert between the first and second upper plates such that one of the first and second upper plates must be moved with respect to the other of the first and second upper plates to place the first insert between the first and second upper plates.

7. The advertising display for holding and displaying inserts above a flat surface as set forth in claim 1, wherein the first and second leg portions are angularly offset with respect to one another by an angle less than one hundred and eighty (180) degrees.

8. The advertising display for holding and displaying inserts above a flat surface as set forth in claim 7, wherein the first and second leg portions are angularly offset with respect to one another by approximately one hundred and twenty (120) degrees.

9. An advertising display for holding and displaying inserts above a flat surface, comprising:

means for holding a first insert including first and second transparent, upper plates disposed parallel to and in close proximity to each other, which are capable of accepting a first insert therebetween; and means for supporting the holding means above the flat surface including first and second leg portions which are substantially smaller in one dimension than the upper plates, wherein the first and second leg portions each include;

a transparent lower display plate;

a lower support plate disposed at a small acute angle to and in close proximity to the lower display plate; and an end portion connecting one end of the lower display plate to one end of the lower support plate;

wherein each leg portion is capable of accepting a further insert between the lower display plate, the lower support plate and the end portion, wherein the lower support plates of the first and second leg portions are angularly offset with respect to one another and include edges which are in close proximity to one another and wherein a lip is attached to three edges of one of the first or second upper plates and is disposed adjacent to the other of the first or second upper plates to retain the first insert between the first and second upper plates of the holding means.

10. An advertising display for displaying multiple printed advertisements above a flat surface, comprising first, second, third, fourth, fifth and sixth flat display pieces formed of a continuous piece of material, wherein:

the first display piece is angularly offset from the second display piece by an angle greater than ninety degrees;

the third display piece is at a first small acute angle to and closely spaced to the second display piece;

the fourth display piece is angularly offset from the third display piece by an angle greater than ninety degrees;

the fifth display piece is at a second small acute angle to and closely spaced to the fourth display piece;

the sixth display piece is angularly offset from the fourth display piece by an angle greater than ninety degrees and is parallel and closely spaced to the first display piece;

the first and sixth display pieces are supported perpendicularly with respect to the flat surface, are of a first size and are capable of holding a first printed advertisement of approximately the first size therebetween;

the second and third display pieces are oriented diagonally with respect to the flat surface, are of a second size smaller than the first size and are capable of holding a second printed advertisement of approximately the second size therebetween;

the fourth and fifth display piece are oriented diagonally with respect to the flat surface, are of the second size and are capable of holding a third printed advertisement of approximately the second size therebetween;

the second or third display pieces include ledges attached to two sides thereof for permanently retaining the second printed advertisement between the second and third display pieces; and the fourth or fifth display pieces include ledges attached to two sides thereof for permanently retaining the third printed advertisement between the fourth and fifth display pieces.

11. The advertising display for displaying multiple printed advertisements above a flat surface as set forth in claim 10, further including a lip connected to three edges of one of either the first or sixth display pieces and which is disposed adjacent to the other of either the first or sixth display pieces which retains the first printed advertisement between the first and sixth display pieces.

12. The advertising display for displaying multiple printed advertisements above a flat surface as set forth in claim 11, wherein the lip and the ledges are formed of the continuous piece of material.

13. The advertising display for displaying multiple printed advertisements above a flat surface as set forth in claim 12, wherein the first and second small acute angles are equal to zero so that the second and third display pieces are substantially parallel to each other and so that the fourth and fifth display pieces are substantially parallel to each other.

14. An advertising display for displaying first, second and third printed advertisements above a flat surface, comprising, first, second and third display means which are angularly offset from one another with respect to a longitudinal axis which is perpendicular to the normal of the flat surface, wherein:

the first display means includes a first pair of transparent plates disposed parallel to and in close proximity to one another which are capable of accepting a first printed advertisement therebetween;

the second display means includes a second pair of transparent plates disposed parallel to and in close proximity to one another which are capable of holding a second printed advertisement therebetween and a first end portion which attaches the second pair of transparent plates to one another;

the third display means includes a third pair of transparent plates disposed parallel to and in close proximity to one another which are capable of holding a third printed advertisement therebetween and a second end portion which attaches the third pair of transparent plates to one another;

the second and third pairs of transparent plates are smaller than the first pair of transparent plates and support the first pair of transparent plates vertically with respect to the flat surface;

the second pair of transparent plates includes ledges attached to two sides thereof for permanently retaining the second printed advertisement therebetween; and the third pair of transparent plates includes ledges attached to two sides thereof for permanently retaining the third printed advertisement therebetween.

15. The advertising display for displaying first, second and third printed advertisements above a flat surface as set forth in claim 14, wherein the first display means further includes first retaining means attached to one of the first pair of transparent plates for retaining the first printed advertisement between the first pair of transparent plates.

16. The advertising display for displaying first, second and third printed advertisements above a flat surface as set forth in claim 15, wherein the first retaining means includes a lip which is attached to three edges of one of the first pair of transparent plates and which is disposed adjacent to the other of the first pair of transparent plates to retain the first printed advertisement between the first pair of transparent plates.

17. The advertising display for displaying first, second and third printed advertisements above a flat surface as set forth in claim 16, wherein the first, second and third pairs of transparent plates are all formed of a single continuous piece of material.

* * * * *